US010356876B2

(12) United States Patent
Michielan et al.

(10) Patent No.: US 10,356,876 B2
(45) Date of Patent: Jul. 16, 2019

(54) LIGHTING DEVICE AND CORRESPONDING METHOD

(71) Applicant: OSRAM GmbH, Munich (DE)

(72) Inventors: Valerio Michielan, Mogliano Veneto (IT); Matteo Caldon, Fossò (IT)

(73) Assignee: OSRAM GmbH, Munich (DE)

( * ) Notice: Subject to any disclaimer, the term of this patent is extended or adjusted under 35 U.S.C. 154(b) by 1 day.

(21) Appl. No.: 15/688,931

(22) Filed: Aug. 29, 2017

(65) Prior Publication Data

US 2018/0063919 A1 Mar. 1, 2018

(30) Foreign Application Priority Data

Aug. 29, 2016 (IT) ..... 10216000087752

(51) Int. Cl.

| | |
|---|---|
| ***H05B 37/02*** | (2006.01) |
| ***F21S 4/20*** | (2016.01) |
| ***F21V 23/00*** | (2015.01) |
| ***F21V 23/02*** | (2006.01) |
| ***H05B 33/08*** | (2006.01) |

(Continued)

(52) U.S. Cl.

CPC ..... *H05B 37/02* (2013.01); *F21S 4/20* (2016.01); *F21V 23/003* (2013.01); *F21V 23/005* (2013.01); *F21V 23/02* (2013.01); *H05B 33/0815* (2013.01); *H05B 33/0845* (2013.01); *F21Y 2113/00* (2013.01); *F21Y 2115/10* (2016.08)

(58) Field of Classification Search

CPC ..... H05B 37/02; H05B 33/0815; H05B 33/0845; F21V 23/005

See application file for complete search history.

(56) References Cited

U.S. PATENT DOCUMENTS

| | | | | |
|---|---|---|---|---|
| 2012/0217900 | A1* | 8/2012 | Kanamori | H05B 33/0815 315/297 |
| 2014/0145631 | A1* | 5/2014 | Li | H05B 33/0803 315/192 |
| 2015/0159818 | A1* | 6/2015 | Dong | H05B 33/0854 315/151 |

FOREIGN PATENT DOCUMENTS

| | | | |
|---|---|---|---|
| EP | 3012511 | A1 | 4/2016 |
| JP | 2005123178 | A | 5/2005 |

(Continued)

OTHER PUBLICATIONS

Italian Search Report based on application No. 201600087752 (7 pages) dated May 19, 2017 (Reference Purpose Only).

*Primary Examiner* — Laura A Gudorf

(74) *Attorney, Agent, or Firm* — Viering Jentschura & Partner MBB

(57) ABSTRACT

According to the present disclosure, a lighting device provides: an elongate support element, a plurality of lighting units distributed along the length of said support element, each of said units including: a set of electrically powered light radiation sources, a driver supplying said set of light radiation sources with a supply current having an intensity which is a function of an impedance value sensed at a current control input of driver. At least one of said lighting units includes a mounting seat for a lighting adjustment impedance, said seat having an electrical connection to the current control input of at least one driver, so that the intensity of the current supplied by driver to a respective set of light radiation sources is a function of the impedance value of a lighting adjustment impedance arranged at said seat.

9 Claims, 3 Drawing Sheets

(51) Int. Cl.
*F21Y 113/00* (2016.01)
*F21Y 115/10* (2016.01)

(56) References Cited

FOREIGN PATENT DOCUMENTS

| | | | |
|---|---|---|---|
| WO | 2012104800 | A2 | 8/2012 |
| WO | 2014178595 | A1 | 11/2014 |

* cited by examiner

LIGHTING DEVICE AND CORRESPONDING METHOD

CROSS-REFERENCE TO RELATED APPLICATION

This application claims priority to Italian Patent Application Serial No. 102016000087752, which was filed Aug. 29, 2016, and is incorporated herein by reference in its entirety.

TECHNICAL FIELD

The present description relates to lighting devices.

One or more embodiments may refer to lighting devices employing electrically-powered light radiation sources, e.g. solid-state light radiation sources, such as LED sources.

BACKGROUND

In various applications of lighting modules, e.g. LED lighting modules, (e.g. elongate modules currently known as "flex" modules), the need may be felt to have different light brightness values along the length of the lighting module.

For example, some applications may require a light brightness level/lumen output of about×1 m/m at a certain portion, and then different light brightness levels, which may be higher or lower, at other portions.

In order to meet such need it is possible to resort to different, e.g. LED, lighting modules, each being adapted to ensure a certain lumen package.

This solution may however suffer from various disadvantages.

For example, modules having different lumen output may have a different appearance, for example as regards the light radiations sources, e.g. LED sources, mounted thereon.

In the same way, lighting modules having different light brightness may have light radiation sources (e.g. LED sources) distributed with different pitches, originating a lack of uniformity which may be perceived as aesthetically unpleasant.

Modules having mutually different lighting levels may moreover go with different connectors which require e.g. respectively different cables, posing moreover the risk that the bulk of the connectors may hinder mounting the modules, e.g. because it hampers the abutment of the ends of two adjacent modules.

A further possible drawback may be due to the fact that, once installed, the lighting device may hardly allow a modification e.g. in the lighting features, leading to low flexibility of employment.

SUMMARY

One or more embodiments aim at overcoming the previously outlined drawbacks.

According to one or more embodiments, said object may be achieved thanks to a lighting device having the features specifically set forth in the claims that follow.

One or more embodiments may also concern a corresponding method.

The claims are an integral part of the technical teaching provided herein with reference to the embodiments.

One or more embodiments may offer one or more of the following advantages:

- the lighting devices (modules) are adapted to provide different light brightness levels at different portions (e.g. in each SEU=Single Electrical Unit), while using however one and the same casing or package, therefore avoiding possible lacks of uniformity (e.g. as regards LED sources) in different portions of the lighting device;
- SEUs may have different light brightness levels while however keeping a constant spacing (pitch) from one source to another, reaching an aesthetically pleasant uniformity;
- said results may be achieved by using substantially equal modules, ideally coupleable with each other, the possibility being given of using one single (type of) connector;
- the brightness level of the single lighting sources may be varied selectively;
- the intensity level may be adjusted also as regards current absorption by the single units, e.g. by changing the position of the connectors;
- it is possible to use an assortment of connectors with regulating resistors having different resistance values, so as to achieve different lumen output levels in different sections/portions of the lighting device.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

It will be appreciated that, for better clarity and simplicity of illustration, the various Figures may not be drawn all to the same scale.

DETAILED DESCRIPTION

In the following description, various specific details are given to provide a thorough understanding of various exemplary embodiments. The embodiments may be practiced without one or several specific details, or with other methods, components, materials, etc. In other instances, well-known structures, materials or operations are not shown or described in detail to avoid obscuring various aspects of the embodiments.

Reference throughout this specification to "one embodiment" or "an embodiment" means that a particular feature, structure, or characteristic described in connection with the embodiment is included in at least one embodiment. Thus, the possible appearances of the phrases "in one embodiment" or "in an embodiment" in various places throughout this specification are not necessarily all referring to the same embodiment. Furthermore, particular features, structures, or characteristics may be combined in any suitable manner in one or more embodiments.

The headings provided herein are for convenience only, and therefore do not interpret the extent of protection or scope of the embodiments.

Figure 1:
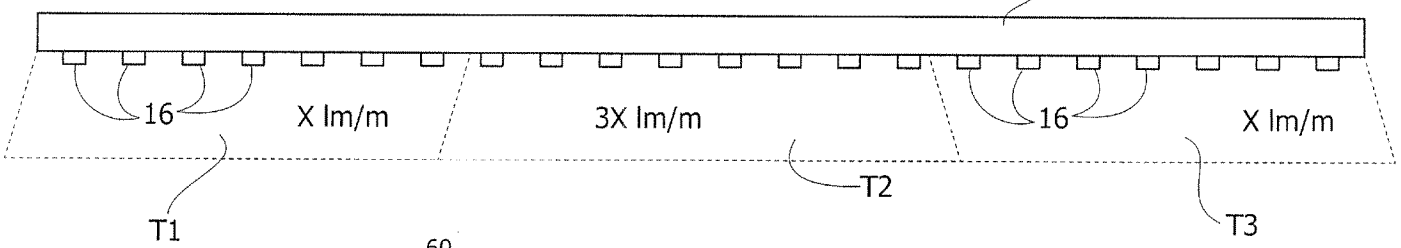
FIG. 1 is a schematic representation of a possible application of one or more embodiments.

In FIG. 1, reference 10 generally denotes a lighting device having an elongate (linear) shape.

In one or more embodiments, lighting device 10 may employ electrically powered light radiation sources (denoted as 16 in the following), such as solid-state light radiation sources.

One or more embodiments may employ LED light radiation sources.

As already stated in the introduction to the description, in some application conditions device 10 may be required to emit light radiation having different brightness (i.e. different lighting) levels in different areas or sections (e.g. T1, T2, T3) of the extension thereof.

For example (without limiting the scope of the embodiments) a certain light brightness level, e.g. ×1 m/m, may be desired in a first section T1 of device 10, followed by a brighter emission, e.g. 3×1 m/m, at a second (e.g. central) section T2, then to fall back to the brightness level ×1 m/m at an end section T3 at the opposite end of the device.

Figure 3:
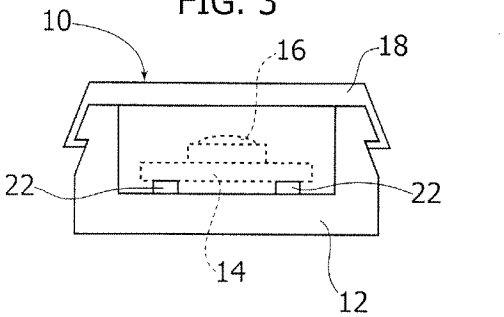
FIGS. 3 to 5 show possible aspects of components according to one or more embodiments, FIG. 5 corresponding approximately to a view along arrow V of FIG. 4, FIGS. 6 to 8, each including two portions respectively denoted as a) and b), exemplify various applications of the embodiments.

In one or more embodiments, device 10 may be implemented as schematically shown in FIG. 3, and therefore it may include an e.g. channel-shaped casing 12, which may have an elongate and optionally flexible shape.

In one or more embodiments, casing 12 may host a substrate or support 14, substantially similar to a ribbon-shaped Printed Circuit Board (PCB), which may optionally be flexible.

In one or more embodiments, substrate 14 may host, with a given spacing pitch which may be assumed as constant, electrically powered light radiation sources 16.

In one or more embodiments, the light radiation sources 16 may be solid-state sources, e.g. LED sources.

In one or more embodiments, device 10 may then be closed by a cover (or by a sealing mass) 18 adapted e.g. to provide device 10 with protection features against the penetration of foreign agents, e.g. with an IP grade protection.

Lighting devices 10 having the previously described features are known in the art, which makes it unnecessary to provide a more detailed description herein.

What previously stated also applies to the electrical driving of the light radiation sources 16. Such driving (supply and optional control functions) may be performed by drivers 20, adapted to provide an electrical current supplying sources 16.

In one or more embodiments, drivers 20 may be configured (as known in itself) so that they may act e.g. as DC-DC current regulators, adapted to determine the intensity of the current supplied to sources (e.g. LEDs) 16 as a function of the impedance (resistance) value of a reference resistor Rext.

Figure 2:
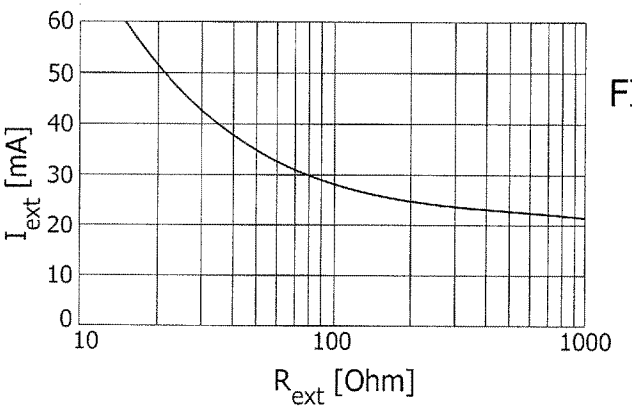
FIG. 2 is a diagram illustrating operation criteria adapted to originate one or more embodiments.

The diagram in FIG. 2 exemplifies a possible dependence of the supply current Iext delivered by said driver 20 as a function of the resistance value of resistor Rext.

For example, in one or more embodiments, the functional relation connecting current Iext to the resistance value of resistor Rext may be a relation such that such a current intensity decreases as the resistance of resistor Rext increases.

Such a functional relation, as shown in FIG. 2, must be construed as merely exemplary, given that one or more embodiments may resort to different functional relations.

FIGS. 6 to 9 exemplify that, in one or more embodiments as also exemplified in FIG. 3, the supply to light radiation sources 16 via one or more drivers 20 may be implemented via two main supply lines ("rails") 22, adapted to be brought, e.g., respectively to the supply voltage value of a "hot" line (e.g. direct 24 V) and to a ground voltage (GND) value. Moreover, the possibility is given to arrange the light radiation sources 16 into a plurality of sets, schematically denoted as A in FIGS. 6 and following, each set A grouping one or more light radiation sources 16 connected to a respective driver 20.

In this regard it will be appreciated that respective sets A of light radiation sources no not necessarily require to be supplied by respective completely separate drivers, as shown herein for simplicity of illustration.

In one or more embodiments, a plurality of sets A of light radiation sources 16 may be supplied by different sections of a single driver. Moreover, the possibility is given to act separately onto such sections, because each of them actually operates as a driver 20 for a certain set A of sources 16, so as to implement, for each set A, an adjustment action on the supply current intensity, e.g. as shown in FIG. 2.

Figure 6:
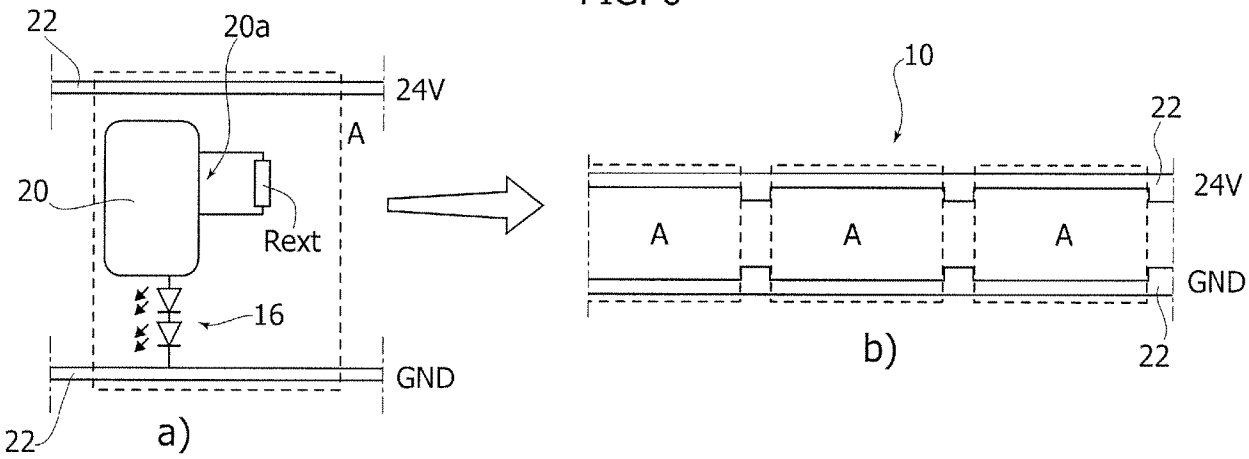
Figure 7:
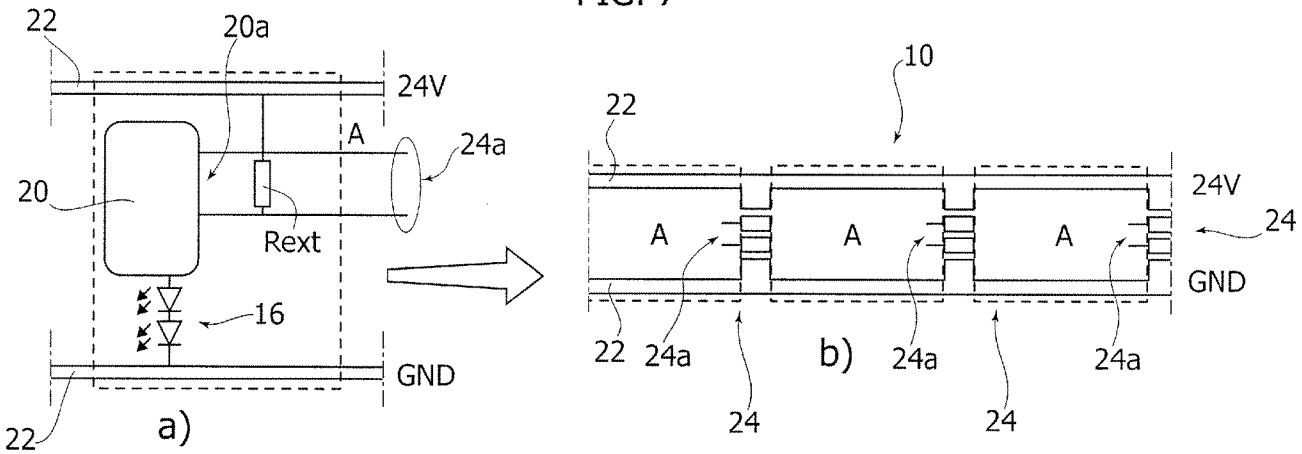

Each set A of light radiation sources 16 may therefore be considered (as schematically shown e.g. in parts a) of FIGS. 6 and 7) as including a certain set of light radiation sources 16 which are adapted to form, together with a respective driver 20, a so-called Single Electrical Unit (SEU).

Moreover, driver 20 is adapted to supply light radiation sources 16 with a supply current the intensity whereof is a function of the resistance value "sensed" by driver 20 at a supply current control input 20*a;* in one or more embodiments as illustrated herein, such an input may be coupled to resistor Rext.

One or more embodiments may envisage a selective action on said resistance (or, more generally, impedance) value sensed at input 20*a,* so as to selectively vary the current intensity value Iext supplied by a given driver 20 to the light radiation sources 16 fed thereby (e.g. the sources included in one and the same SEU).

In one or more embodiments, such a result may be achieved without substantially modifying the intrinsically conventional structure of a device 10 as schematically shown in FIG. 6, in other words, for instance, of a device 10 including a plurality of units A distributed along the length of device 10 itself.

Moreover, each unit A is supplied from the "rails" 22 via a respective driver 20, which provides the radiation sources 16 of the unit with a supply current the intensity whereof is a function of the resistance value sensed at input 20*a*.

Figure 8:
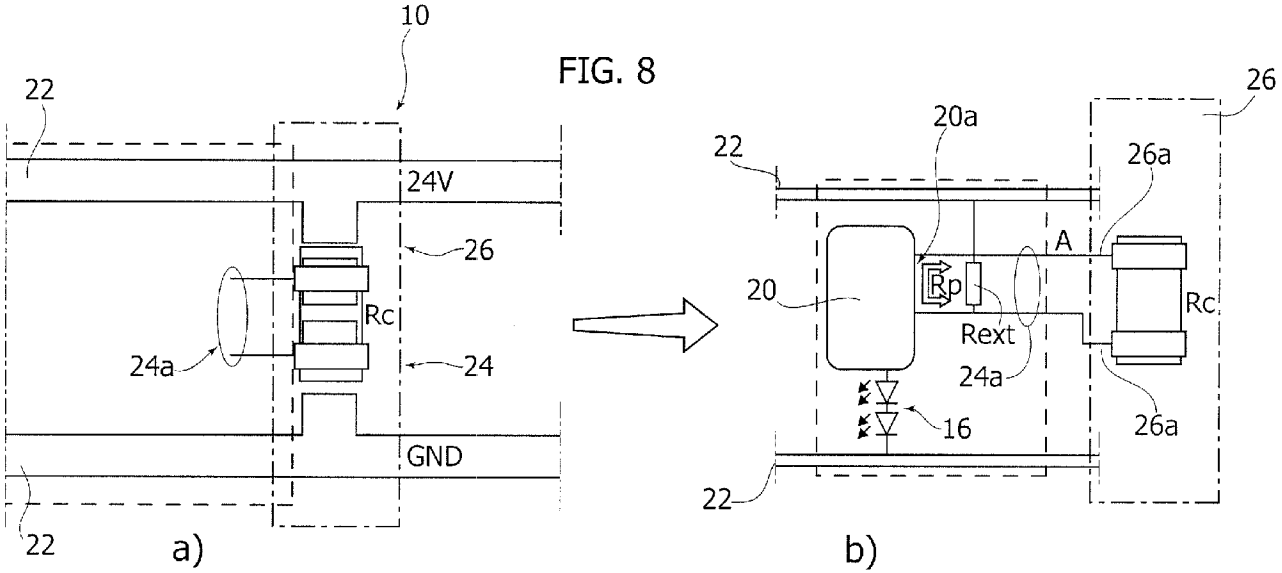
Figure 9:
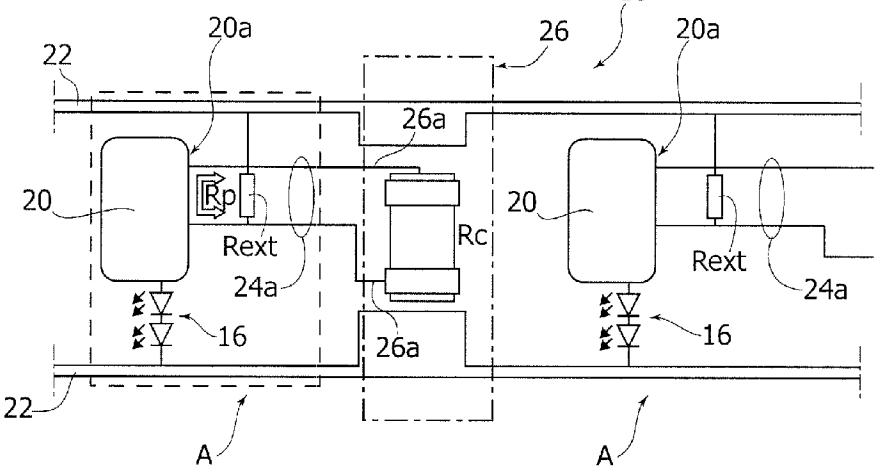
FIG. 9 shows further possible features of embodiments.

One or more embodiments may envisage coupling input 20*a* of one or more drivers included in device 10—in addition or as an alternative to resistor Rext—with a further resistor adjusting the light brightness, such as the resistor denoted as Rc in FIGS. 8 and 9.

In this way, the resistance value adapted to be sensed at input 20*a* of driver 20 may be modified, so as to correspondingly modify the value of the current intensity delivered by driver 20 to the light radiation sources 16 fed thereby. It is therefore possible to accordingly adjust the light brightness emitted by such light radiation sources.

In one or more embodiments, as exemplified herein, instead of replacing resistor Rext, resistor Rc may be coupled, e.g. in parallel, to resistor Rext, so that the resistance value "sensed" at input 20*a* goes from the resistance value of Rext to a resistance value Rp, which corresponds to the parallel connection of Rext and Rc, i.e. Rp=Rext||Rc.

For example, by coupling in parallel a resistor Rext having a resistance value of about 100 Ohm to a resistor Rc having a resistance value of 30 Ohm, the value of the resistance of the parallel connection is about 23 Ohm.

Again by way of example, assuming that, when input 20*a* is connected (only) to resistor Rext, a given driver 20 supplies sources 16 coupled thereto a current having an intensity of 28 mA, by connecting in parallel resistor Rext to a resistor Rc having the above resistance value, the same driver 20 may supply sources 16 with a supply current having an intensity of about 50 mA, which may correspond e.g. to an increase by 60% of the luminous flux emitted by such sources.

In one or more embodiments, the resistors adjusting light brightness, i.e. resistors Rc, may be mounted into the casing of device 10.

For example, in one or more embodiments, in sections between the various units A in housing 12 there may be provided mounting seats 24 (see e.g. portion b) of FIG. 7) from which respective, e.g. double-wired, electrical connection lines 24*a* may depart and may be connected to input 20*a* of a respective driver 20.

In one or more embodiments, as schematically shown e.g. in FIGS. 8 and 9, it is possible to selectively act on each unit A, by coupling (so to say "by default") a respective resistor Rc to resistor Rext, which is normally coupled to the respective driver 20. In this way, it is possible to selectively vary, as a function of the resistance of resistor Rc coupled to resistor Rext:

- the intensity of the supply current delivered by driver 20 to the respective set of light radiation sources 16 and, as a consequence,
- the level of the light radiation brightness emitted by such sources.

In this regard, the following considerations may be made.

As previously stated, in one or more embodiments, instead of being coupled, e.g. in parallel, to resistor Rext, resistor Rc may replace the latter as regards the electrical connection to driver 20.

In one or more embodiments, as an alternative to a parallel connection as exemplified herein, the coupling between resistor Rc and resistor Rext may take place in different ways, e.g. via a series connection.

In one or more embodiments, the resistance value of resistor Rc may be chosen, as a function of the desired effect of varying the supply current and therefore the intensity of the emitted luminous flux, by taking into account the type of coupling resistor Rc to device 10 (replacement/combination to resistor Rext, connection in parallel or in series, etc.).

In addition, although the present specification refers, for simplicity of illustration, to a driver 20 the current intensity whereof is regulated (and therefore selectively adjustable) as a function of the resistance value sensed at input 20*a*, in one or more embodiments a similar effect may be obtained, more generally, as a function of an impedance value (therefore, not necessarily a resistance value) sensed at said input.

Figure 4:
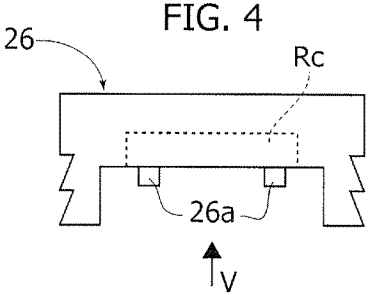
Figure 5:
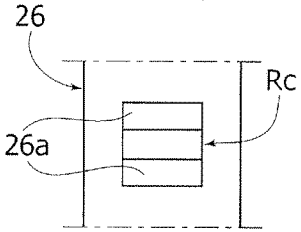

FIGS. 4 and 5 exemplify possible implementations of coupling said impedance (in the present examples, the resistance of resistor Rc) to the input 20*a* of each driver 20.

For example, FIGS. 4 and 5 exemplify the possibility of embedding a resistor Rc into an e.g. plastic casing, substantially shaped as a bridge and adapted to be vested onto casing 12 of device 10 (after an optional temporary removal of cover 18, or by taking advantage of openings or interruptions thereof, or of an optional corresponding sealing mass) in the location where a seat for the insertion of a resistor Rc is to be arranged.

In one or more embodiments, such an insert 26 may be provided e.g. with electrical contacts (rheophores) 26*a*, adapted to electrically contact lines 24*a* so as to couple resistor Rc to input 20*a* of driver 20.

Thanks to the possibility of selectively adjusting the lighting level produced by each unit A, one or more embodiments offer particularly flexible usage options.

For example, said variation of the lighting brightness in different areas or sections of device 10 (see for example FIG. 1) may be performed by the final user, without requiring the intervention of a skilled worker or the use of specific tools.

One or more embodiments may therefore concern a lighting device (e.g. 10), including

- an elongate support element (e.g. 12),
- a plurality of lighting units (e.g. A) distributed along the length of said support element, each of said units including:
- a set of electrically-powered light radiation sources (e.g. 16),
- a driver (e.g. 20) supplying said set of light radiation sources with a supply current having an intensity (e.g. Iext) which is a function of an impedance (e.g. resistance) value sensed at a current control input (e.g. 20*a*) of the driver, wherein at least one of said lighting units includes a seat for a lighting adjustment impedance (e.g. Rc), said seat having an electrical connection (e.g. 24*a*) to the current control input of at least one driver, so that the intensity of the current supplied by said at least one driver to a respective set of light radiation sources is a function of the impedance value of a lighting adjustment impedance arranged at said seat.

One or more embodiments may include a plurality of said seats for receiving respective lighting adjustment impedances, each seat of said plurality of seats having an electrical connection to the current control input of the driver of a respective unit in said plurality of lighting units distributed along the length of said support element.

In one or more embodiments, said elongate support element may include a channel-like housing with at least one partition separating two adjacent units of said plurality of lighting units, wherein said seat is located at said at least one partition.

In one or more embodiments, said electrical connection to the current control input of said at least one driver may include a connection (e.g. 24*a*) exposed to the electrical coupling with terminals (e.g. 26*a*) of a lighting adjustment impedance arranged at said seat.

One or more embodiments may include a reference impedance (e.g. Rext) coupled to said current control input of said at least one driver, wherein said lighting adjustment impedance arranged in said seat is electrically coupled, optionally in parallel, to said reference impedance.

One or more embodiments may include an assortment of said lighting adjustment impedances received in respective inserts (e.g. 26) coupleable to said elongated support element.

In one or more embodiments, said electrically-powered light radiation sources may include LED sources.

One or more embodiments may concern a method of providing adjustable lighting levels along a line, the method including:

- providing a lighting device according to one or more embodiments,
- arranging said lighting device with said elongated support element extending along said line, and
- coupling at least one lighting adjustment impedance to said at least one seat.

Without prejudice to the basic principles, the details and the embodiments may vary, even appreciably, with respect to what has been described herein by way of non-limiting example only, without departing from the extent of protection.

The extent of protection is defined by the annexed claims.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting device, comprising:

an elongate support element, a plurality of lighting units distributed along the length of said support element, each of said units comprising:

a set of electrically-powered light radiation sources, a driver supplying said set of light radiation sources with a supply current having an intensity which is a function of an impedance value sensed at a current control input of the driver, wherein at least one of said lighting units includes a mounting seat provided on the elongate support element for a lighting adjustment impedance, said mounting seat having an electrical connection to the current control input of at least one driver, wherein the intensity of the current supplied by said at least one driver to a respective set of light radiation sources is a function of the impedance value of a lighting adjustment impedance arranged at said mounting seat.

2. The lighting device of claim 1, further comprising a plurality of said mounting seats for receiving respective lighting adjustment impedances, each mounting seat of said plurality of mounting seats having an electrical connection to the current control input of the driver of a respective unit in said plurality of lighting units distributed along the length of said support element.

3. The lighting device of claim 1, wherein said elongate support element includes a housing with at least one partition separating two adjacent units of said plurality of lighting units, wherein said mounting seat is located at said at least one partition.

4. The lighting device of claim 1, wherein said electrical connection to the current control input of said at least one driver includes a connection exposed to electrical coupling with terminals of a lighting adjustment impedance arranged at said mounting seat.

5. The lighting device of claim 1, further comprising a reference impedance coupled to said current control input of said at least one driver, wherein said lighting adjustment impedance arranged in said mounting seat is electrically coupled, to said reference impedance.

6. The lighting device of claim 1, further comprising an assortment of said lighting adjustment impedances arranged in respective inserts couplable to said elongated support element.

7. The lighting device of claim 1, wherein said electrically-powered light radiation sources include LED light sources.

8. A method of providing adjustable lighting levels along a line, the method comprising:

providing a lighting device, wherein the lighting device comprises:

an elongate support element, a plurality of lighting units distributed along the length of said support element, each of said units including:

a set of electrically-powered light radiation sources, a driver supplying said set of light radiation sources with a supply current having an intensity which is a function of an impedance value sensed at a current control input of the driver, wherein at least one of said lighting units includes a mounting seat provided by the elongate support element for a lighting adjustment impedance, said mounting seat having an electrical connection to the current control input of at least one driver, wherein the intensity of the current supplied by said at least one driver to a respective set of light radiation sources is a function of the impedance value of a lighting adjustment impedance arranged at said mounting seat;

arranging said lighting device with said elongated support element extending along said line, and coupling at least one lighting adjustment impedance to at least one mounting seat.

9. The lighting device of claim 5, wherein said lighting adjustment impedance arranged in said mounting seat is electrically coupled in parallel to said reference impedance.

* * * * *